United States Patent [19]

Peterson et al.

[11] Patent Number: 5,028,210

[45] Date of Patent: Jul. 2, 1991

[54] PROPELLER UNIT WITH CONTROLLED CYCLIC AND COLLECTIVE BLADE PITCH

[75] Inventors: Frank B. Peterson, McLean, Va.; William E. Schneider, Annapolis, Md.; Christopher N. Sears, Shady Side, Md.; Darrel J. Brydebell, Arnold, Md.; Mark W. Smith, Gaithersburg, Md.

[73] Assignee: The United States of America as represented by the Secretary of the Navy, Washington, D.C.

[21] Appl. No.: 461,586

[22] Filed: Jan. 5, 1990

[51] Int. Cl.[5] ..... B63H 21/17

[52] U.S. Cl. ..... 416/164; 416/170 R; 440/6; 440/50

[58] Field of Search ..... 416/147, 148, 149, 150, 416/156, 164, 170 R; 440/6, 50; 114/330

[56] References Cited

U.S. PATENT DOCUMENTS

| | | | |
|---|---|---|---|
| 2,714,866 | 8/1955 | Plenger et al. | 416/170 R |
| 2,727,485 | 12/1955 | Combs | 416/170 R |
| 2,850,106 | 9/1958 | Swan | 440/50 X |
| 3,101,066 | 8/1963 | Haselton | 114/330 |
| 3,291,086 | 12/1966 | Haselton | 114/330 |
| 3,450,083 | 6/1969 | Haselton | 114/330 |
| 3,914,629 | 10/1975 | Gardiner | 440/6 X |
| 4,648,345 | 3/1987 | Wham et al. | 440/50 X |
| 4,744,727 | 5/1988 | Muller | 416/164 X |

OTHER PUBLICATIONS

Richard S. Brannin, "Tandem Propellers", pp. 37–43.

Nanba et al, "Development of Variable Propeller", Journal of Kansai Society of Naval Architects, No. 210, Sep. 1988 pp. 1–8.

Kawasaki Heavy Industries' Advanced Robot Technology Research Assoc. Using Varivec Propeller System, (Advertisement), May 1988.

*Primary Examiner*—Edward K. Look

*Assistant Examiner*—James A. Larson

*Attorney, Agent, or Firm*—Luther A. Marsh; John H. Stowe; Sol Sheinbein

[57] ABSTRACT

An improved integral marine propulsion unit is disclosed that can generate a thrust vector in any of three degrees of motion. The unit utilizes both collective and cyclic propeller blade pitch angle variation to generate these thrust. This unit obviates the need for control surfaces and rudders for motion control of a marine vessel. Additionally, this unit provides flexibility in external propulsor arrangements on a marine hull. The unit integrates the swash plate mechanism and actuators within the central bore of a ring type prime mover.

9 Claims, 4 Drawing Sheets

END VIEW

BOTTOM VIEW

AHEAD THRUST-(COLLECTIVE PITCH)

END VIEW

RIGHT SIDE

PROPELLER UNIT WITH CONTROLLED CYCLIC AND COLLECTIVE BLADE PITCH

STATEMENT OF GOVERNMENT INTEREST

The invention described herein may be manufactured and used by or for the Government of the United States of American for governmental purposes without the payment of any royalties thereon or therefor.

FIELD OF THE INVENTION

The present invention relates to an improved marine impeller type propulsion unit, and more particularly, to a totally immersed electro-mechanical propeller unit for motion control of a marine vessel in multiple degrees of freedom. The unit operates flooded in ocean ambient.

BACKGROUND OF THE INVENTION

Most marine craft presently are propelled and controlled by single fixed propulsor devices such as screws and control surfaces. This has limited the placement of shipboard internal propulsor machinery that drives the propeller and has required additional drag producing motion control appendages such as rudders and diving planes. A small number of other marine craft use alternate mechanical propulsors that use propulsion units that change a propeller's cyclic and collective blade pitch that in turn generates thrust vectors in up to six degrees of freedom. Such propulsors use a swash plate for the pitch control mechanism. Applications of this include ship secondary propulsors that use a Voith-Schneider propeller and underwater submersibles. Particular means of mechanically varying the propeller blade pitch have included the use of a swash plate ring that floats on rubber or steel spring mounts to permit freedom of movement when the actuators push and pull the ring along the axis of rotation and when the ring is angled to the axis of rotation. This is shown in U.S. Pat. No. 3,101,066 of Haselton titled "Submarine Hydrodynamic Control System". Limitations and disadvantages of this system include: 1) an admission in U.S. Pat. No. 3,450,083 Background section describing the prior propulsion system in U.S. Pat. No. 3,101,066 as "lacking durability" and exhibiting "much lost motion", 2) this system is limited to use in a tandem propeller type propulsion configuration that precludes its use on other marine vessels such as a surface vessel; 3) the ring ac propulsion motor as shown does not incorporate both the swash plate control mechanism and actuator means in the central bore section of the motor that makes for an integral propulsion unit; and 4) the floating swash plate ring requires a large open bore structure for its placement which induces lost motion.

Haselton's U.S. Pat. No. 3,450,083 titled "Submarine Hydrodynamic Control System", discloses an improved way of supporting the swash plate ring which controls the cyclic and collective pitch of a many bladed propeller with an internal ring gear drive mechanism. Limitations and disadvantages of this system include: 1) the drive motors use of rotating shaft seals that may leak; 2) the need for a conventional in-line motor for driving the bull gear drive unit, thus requiring more internal marine vessel space; and 3) this system is limited to use in a tandem propeller type propulsion configuration that precludes its use on other maine vessels such as a surface vessel.

Other propulsion units developed and is closed include Kawasaki Heavy Industries' Varivec propeller unit which consists of a swash plate that is actuated by servo-actuators which alters each propeller blade's combined cyclic and collective pitch that generate thrust in any direction. Limitations and disadvantages of this unit include: 1) the need for a rotating shaft seal on the electric motor; and 2) and in-line electric motor/-speed reducer unit that requires more internal vessel space, thus limiting the flexibility for drive unit placement on a marine vessel.

SUMMARY OF THE INVENTION

The present invention provides a marine propulsion unit for securement exteriorly of a marine hull, which comprises, a ring shaped prime mover defining a central bore section with a central axis; a plurality of propulsion blades radially extending from a hub on said axis; said blades being capable of pivotal movement whereby the pitch angle thereof is adjusted selectively to provide heave, sway and surge motion to said hull; a swash plate mechanism within the central bore section of said ring shaped prime mover for controlling said blade pitch collectively and cyclically during the rotation of said hub, and wherein said swash plate mechanism (36, 42, 52) securely supported by an axial movable spherical support bearing (56) within said central bore and proximal to the centerline of said ring shaped prime mover (38, 40); and multiple actuators attached to said swash plate mechanism for controlling said pitch, said actuators (45, 48) being disposed within said central bore.

OBJECTS OF THE INVENTION

It is the primary object of the present invention to provide an improved electro-mechanical marine propeller unit for varying a propeller blade's pitch angle during the rotation thereof.

It is another object of the present invention to provide an improved propeller unit for varying the pitch angle of a multi-bladed propeller both cyclically and collectively.

Still another object of the present invention is to eliminate the need for a prime mover that is in-line to a swash plate mechanism, thus enlarging a unit's overall size and weight.

It is still another object of the invention to eliminate the need for a rotating shaft seal passing through a marine pressure hull or prime mover unit that operates in the wet.

It is still another object of the invention to make an improved integral marine propulsion unit where the swash plate mechanism is within the central bore and proximal to the centerline of the prime mover and all components operate in ocean ambient conditions.

It is still another object of the invention to provide an improved marine propeller unit that allows for greater flexibility of a marine vessel's propulsor configuration.

These and other objects of the invention will become more readily apparent in the ensuing specification when taken together with the drawings.

DESCRIPTION OF THE PREFERRED EMBODIMENT

Figure 1A:
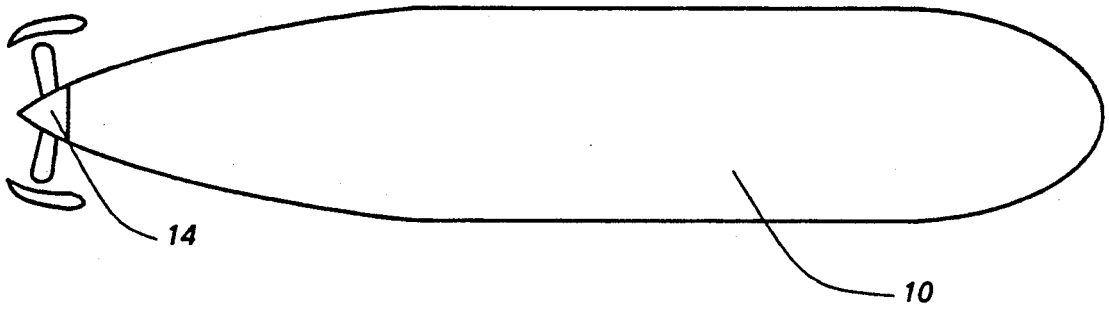
FIGS. 1*a* and 1*b* are is a diagrammatic view of marine vessels equipped with the improved propeller unit of the present invention.
Figure 1B:
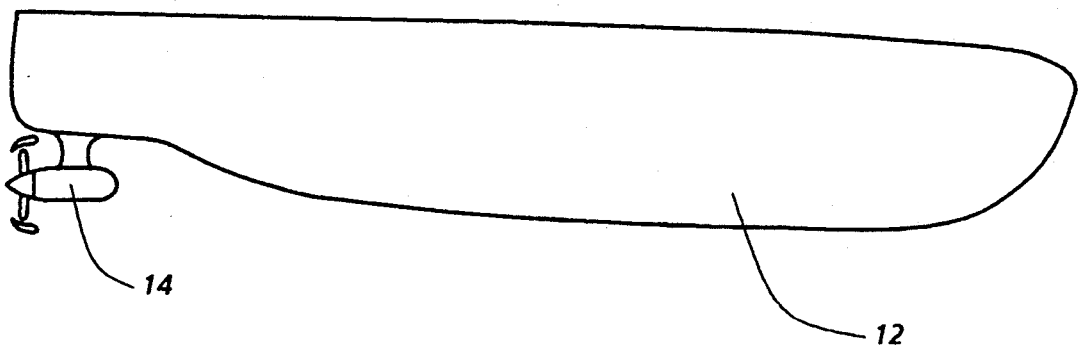
Figure 2A:
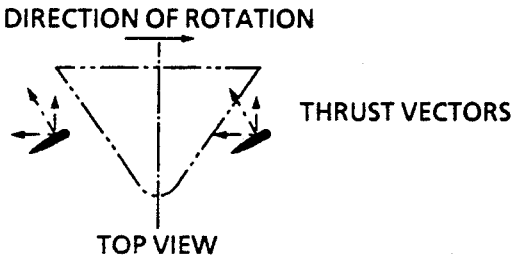
FIGS. 2*a*, 2*b*, 2*c* are a top, end, and bottom view, respectively, of the propulsor to demonstrate the concept of collective pitch producing ahead thrust, including the direction of rotation and the resulting thrust vector.
Figure 2B:
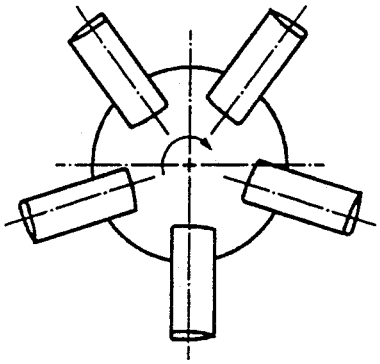
Figure 2C:
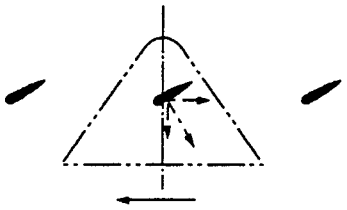
Figure 2D:
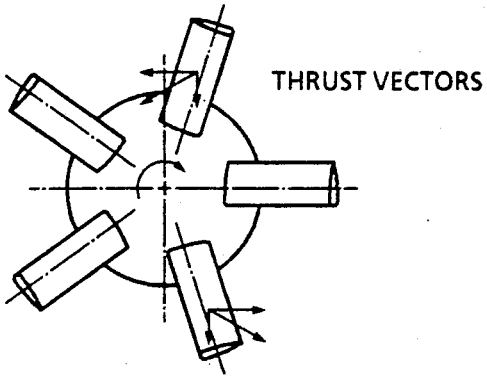
FIGS. 2*d*–2*e* are an end view and right side view, respectively, of the propulsor to demonstrate the concept of cyclic pitch producing maximum down thrust, including the direction of rotation and the resulting thrust vector.
Figure 2E:
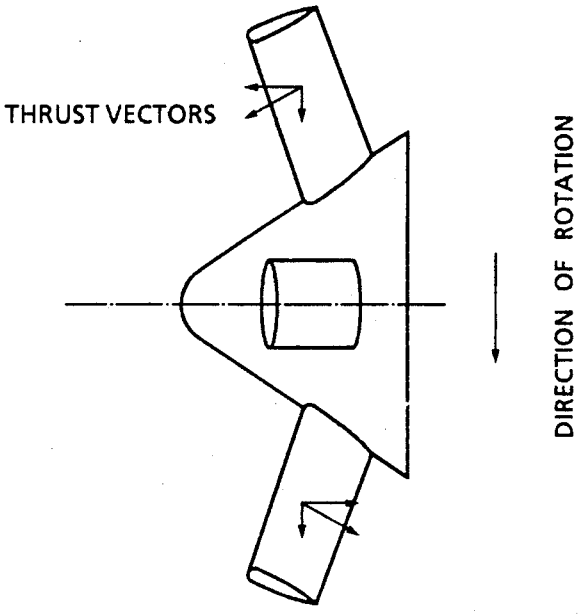

In FIGS. 1*a* and 1*b*, perspective views of marine applications are shown where the propeller unit (14) as presently disclosed is used on a submersible craft (10) or surface vessel (12).

The operating principles of a sole propeller unit (14) is similar to that of a helicopter rotor where during normal operation, the unit will rotate at constant speed and direction. The unit (14) utilizes both collective and cyclic pitch angle variations to generate a thrust vector in any of three degrees of motion, viz. translational movement of surge (fore-aft), sway (athwartship) and heave (vertical). By definition, the pitch angle refers to angle that the propeller blades (18) make with tangents to circle of rotation. The cycle pitch controls magnitude and direction of the transverse thrust that is perpendicular to the longitudinal axis of the marine vessel. The propeller unit (14) can vary in both magnitude and point on the circle of rotation at which the peak cyclic pitch magnitude occurs. For example, with pure collective pitch variation, each blade's pitch angle is equal during the propeller rotation that in turn imparts either a forward, reverse or no propulsive thrust to a marine vessel. With cyclic pitch variation, each blade's angle continually varies with respect to the circle of rotation's tangent. With the propeller blades in a neutral collective thrust position, cyclic pitch changes can effect perpendicular thrust to the longitudinal axis of the propulsion unit without forward or reverse motions. When the collective pitch is super imposed on the cyclic pitch, all three degrees of motion are possible from a sole propeller unit (14). All these motions can be generated without the need for conventional control surfaces such as rudders and/or diving planes. FIGS. 2*a*–2*e* illustrate the principles of thrust generation that will bring about desired marine vessel motions.

Figure 3:
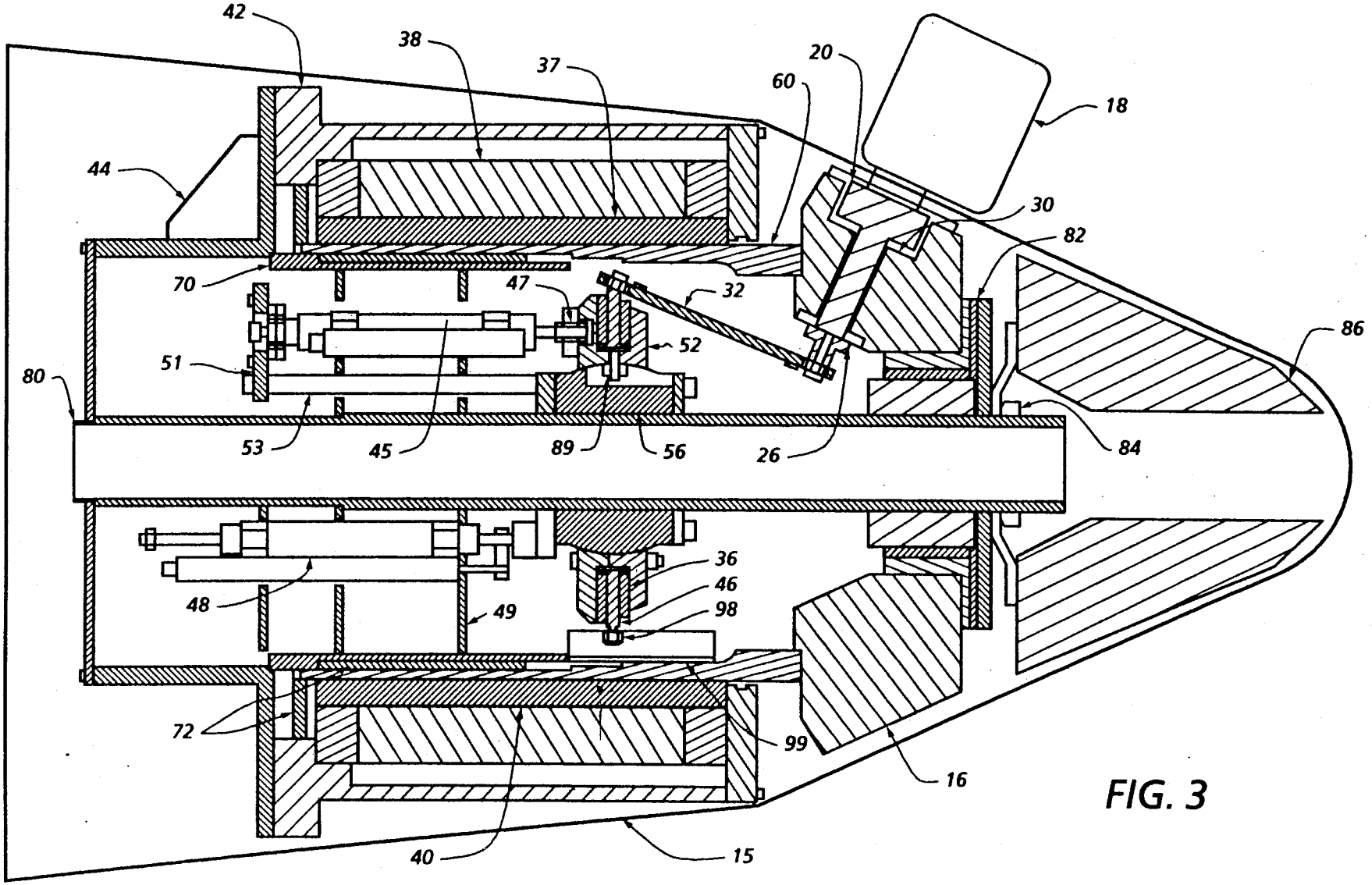
FIG. 3 is a cross sectional view of the propeller control mechanism according to the invention.

In FIG. 3, the propeller unit (14) with cowling structure (15) is shown which comprises a propeller hub (16) having a diameter substantially equal to the cross sectional diameter of the prime mover (38,40) Pivotally mounted in the hub (16) are propeller blades (18), the axis of the blades being perpendicular to conical aft section of the propeller unit (14). Each blade (18) is equal angularly spaced about the hub (16) and is mounted for pivotal motion on a propeller pivot shaft (20). A pivot shaft (20) penetrates the hub (16) which supports an appropriate bearing bore support mechanism (30). The pivot shaft (20) is fitted with crank arm (26) which is attached through a ball joint to swash plate ring (46) which slides in a water lubricated U-shaped bearing (36).

Rotation of the propeller blades (18) simultaneously with the hub (16) for propulsion of a marine vessel is accomplished by an open bore permanent magnet brushless DC torque motor (37) that operates with all components exposed to ocean ambient conditions. This type of motor can operate at relatively slow speeds and high output shaft torques that makes for efficient propeller operation. The motor armature (38) is an epoxy encapsulated stator unit that comprises a laminated stator core and multiphased motor windings. For deep ocean applications, the armature would be enclosed in an oil filled pressure compensated housing. Motor rotor (40) comprises a banded permanent magnet section that is attached to a backing ring. The rotor (40) is keyed and transmits torque directly to propeller shaft (60) which in turn is rigidly fixed to hub (16) which turns propeller blades (18). The armature axial clamping housing (42) maintains the motor armature (38) stationary and axially aligned with the motor rotor (40). The housing (42) is attached to the propeller unit support framing (44). Alternate physical representations of this motor includes making the rotor (40) anterior to the stator (38) and enlarging the propeller tube (60) so as to surround and be directly coupled to the rotor (40).

Figure 4:
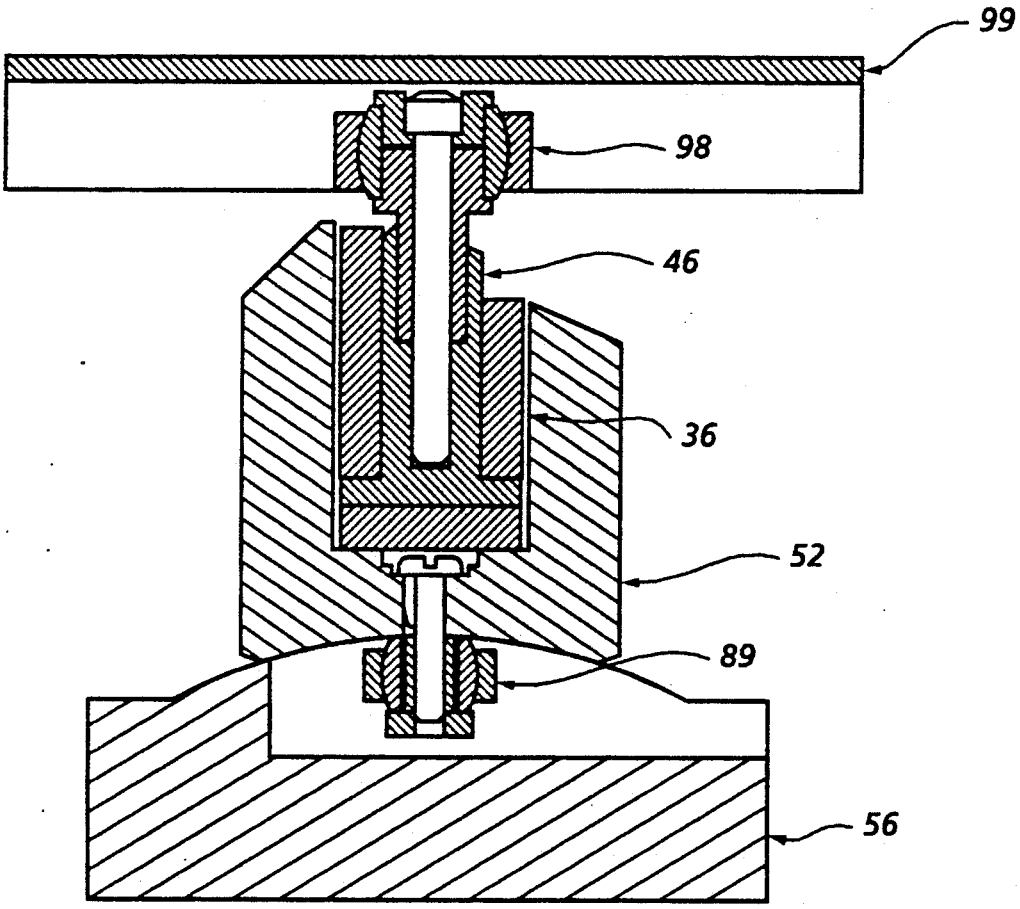
FIG. 4 is a perspective view of the swash plate control mechanism in conjunction with the propeller operation according to the invention.

Support for the rotating propeller shaft (60) is provided by stationary outer support tube (70) and inner support tube (80), both of which are rigidly attached to propeller unit support framing (44). Actuator support plate (49) is rigidly attached to outer support tube (70) and inner support tube (80) and has inner and outer circumscribed radial lighting holes that provide a rigid stationary attachment section for actuators (48). Thrust and relative motion between the propeller shaft (60) and outer tube (70) is provided by radial and thrust bearings (72). Thrust and relative motion between the hub (16) and inner support tube (80) is provided by radial and thrust bearings (82). The hub (16) is radially and axially aligned and held in place by lock nut (84) on to the threaded inner support tube (80). The fair weather cap (86) is attached to the end of the propeller hub (16). As shown in FIG. 4, transferring the rotary motion of the propeller shaft (60) to the swash plate (46) is accomplished by a scissor bearing (98) that is secured to the outside diameter of the swash plate (46) and rides in a channel (99) that is mounted to the inside of the propeller shaft (60). As the propeller shaft and channel rotate, the outer race of the scissor bearing (98) contacts the wall of the channel and transfers the rotational motion to the swash plate. This allows the link arms (32) to actuate the blades without having to carry the rotational load as well. A second scissor bearing (89) is utilized to prevent the bearing pad (52) from being rotated by the frictional drag of the swash plate (46). To accomplish this, the scissor bearing (89) is mounted on the inside surface of the bearing pad (52). The bearing rides in a slot that is milled in the spherical support bearing (56) which allows the required motion of the bearing pad but prevents rotation.

In the propeller mechanism (14), there are several paired and diametrically opposed actuators (45,48) required to perform cyclic and collective pitch changes. The swash plate ring (46) is confined by the bearing (36) which is mounted in bearing pad (52) so that it can be moved fore, aft and tilted by action of double acting hydraulic cylinder actuators (45,48). Alternate actuators include electric linear actuators with ball and screw mechanism and double acting pneumatic cylinder units. At least two actuators are required for cyclic pitch change that are displaced 90 mechanical degrees within the outer support tube (70). The aft end of cyclic actuator's (45) double acting cylinder rod is attached to spherical bearings (47) that is attached to bearing pad (52). The forward end of cyclic actuator (45) is attached to collective actuator plate (51) that is in turn attached to cyclic change push rod (53). The other end of push rod (53) is attached to the forward side of spherical support bearing (56). The spherical support bearing (56) moves axially on inner support tube (80). Thus, when the collective actuator (48) is operated, the entire bearing pad (52) and spherical support bearing (56) moves in unison. The collective actuators (48) are rigidly attached to the inner radial holes of actuator support plate (49) and each actuator's (48) push rod is attached to the front side of spherical support bearing (56). Thus, when collective actuators (48) will equally move the spherical support bearing (56) an equal displacement fore or aft on inner support tube (80) that in turn effects a collective pitch change of all propeller blades (18). When the swash plate (46) is moved for cyclic pitch changes in propeller blades (18), the actuator (45) on one side of the unit will pull the swash plate inwards while another actuator (45) on the other side of the unit will push the swash plate aft. For cyclic pitch variation, the bearing pad (52) will pivot upon the spherical surface of the spherical support bearing (56).

MODE OF OPERATION

From the above description, the pitch of the propeller blades (18) may be controlled collectively or cyclically by actuators (45,48) in unison or selectively respectively. When a collective pitch change is required, all actuators (48) will change in unison or selectively respectively. When a collective pitch change is required, all actuator (48) will change in unison fore or aft that in turn will cause swash plate (46) to move in a restricted fore or aft movement that ultimately causes the leading edge of the propeller blades (18) to move in unison fore or aft. To provide steering effect and motion perpendicular to the longitudinal axis of the propulsion unit, the pitch of the propeller blades (18) may be changed selectively. This in turn requires no movement of spherical support bearing (56). The swash plate (46) on one side of the unit will roll forward on the spherical support bearing (56) while rolling aftwardly on the other side of this bearing (56). Thus, it is possible to generate a thrust vector in any of three degrees of motion with this propulsion unit.

The foregoing description taken together with the appended claims constitutes the disclosure such as to enable a person skilled in the electrical, marine, ocean engineering and naval architecture arts having the benefit of the teachings contained therein to make and use the unit of the invention, and, in general, constitutes a meritorious advance in the art unobvious to such a person not having the benefit of these teachings.

Accordingly, the invention having been described in its best embodiment and mode of operation, that which is desired to be claimed by Letters Patent is:

1. In a marine propulsion unit for securement exteriorly of a marine hull, wherein the unit has a ring shaped prime mover defining a central bore section with a central axis; a plurality of propulsion blades radially extending from a hub on said axis; said blades being capable of pivotal movement whereby the pitch angle thereof is adjusted selectively to provide heave, sway and surge motion to said hull; a swash plate mechanism within the central bore section of said ring shaped prime mover for controlling said blade pitch collectively and cyclically during the rotation of said hub; and multiple actuators attached to said swash plate mechanism for controlling said blade pitch; the improvement comprising: said swash plate mechanism is securely supported by an axial movable spherical support bearing within said central bore and proximal to the centerline of said ring shaped prime mover and said actuators being disposed within said central bore and said prime mover is a brushless DC motor.

2. The improvement of claim 1 wherein said swash plate mechanism comprises a swash plate ring which is confined and slides within a substantially U-shaped swash plate bearing mounted in a bearing pad whereby said swash plate mechanism can pivot on said spherical bearing and a coupling means connecting the swash plate ring to the propeller blades whereby the propeller blades may be pivoted in collective and cyclic pitch, responsive to longitudinal and tilting movement of said swash plate ring.

3. The improvement of claim 2 wherein said ring shaped prime mover comprises a tubular rotor that rotates within a tubular stator.

4. The improvement of claim 3 further comprising a stationary inner support tube within said central bore on which said spherical support bearing longitudinally slides and a stationary outer support tube whose outer surface is a bearing journal for a fastened concentric propeller shaft tube and inner surface of said tubular rotor.

5. The improvement of claim 4 further comprising a first scissor bearing fastened to the outer surface of said swash plate that slides longitudinally within a channel that is mounted to said propeller shaft whereby rotary motion from said propeller shaft is coupled to said swash plate.

6. The improvement of claim 4 further comprising a second scissor bearing located in the outer surface of said spherical support bearing whereby said bearing pad is non-rotatable about said inner support tube.

7. The improvement of claim 1 wherein said actuators are double acting hydraulic cylinders.

8. The improvement of claim 1 wherein said actuators are double acting pneumatic cylinders.

9. In a marine propulsion unit for securement exteriorly of a marine hull, wherein the unit has a ring shaped prime mover defining a central bore section with a central axis; a plurality of propulsion blades radially extending from a hub on said axis; said blades being capable of pivotal movement whereby the pitch angle thereof is adjusted selectively to provide heave, sway and surge motion to said hull; a swash plate mechanism within the central bore section of said ring shaped prime mover for controlling said blade pitch collectively and cyclically during the rotation of said hub and multiple actuators attached to said swash plate mechanism for controlling said blade pitch; the improvement comprising: said swash plate mechanism is securely supported by an axial movable spherical support bearing within said central bore and proximal to the centerline of said ring shaped prime mover; said actuators being disposed within said central bore and said ring shaped prime mover comprises a tubular rotor that rotates within a tubular stator and is a brushless DC motor that operates in ocean ambient conditions.

* * * * *